United States Patent [19]

Tye

[11] 4,145,952

[45] Mar. 27, 1979

[54] AIRCRAFT GUN SIGHT SYSTEM AND METHOD FOR HIGH ANGLE-OFF ATTACKS

[76] Inventor: Gene Tye, 2921 Holly La., Endwell, N.Y. 13760

[21] Appl. No.: 766,035

[22] Filed: Feb. 3, 1977

[51] Int. Cl.[2] ..... F41G 3/08; F41G 3/22

[52] U.S. Cl. ..... 89/41 EA; 235/404; 356/29; 364/423

[58] Field of Search ..... 33/239; 89/41 E, 41 EA; 235/61.5 E, 61.5 S, 404; 356/29, 251, 252; 364/423

[56] References Cited

U.S. PATENT DOCUMENTS

| | | | |
|---|---|---|---|
| 2,467,831 | 4/1949 | Johnson | 356/29 |
| 2,957,245 | 10/1960 | Kimble | 356/252 |
| 2,957,384 | 10/1960 | Raninen | 356/252 |
| 2,979,711 | 4/1961 | Shelley | 356/252 |
| 3,024,536 | 3/1962 | Kuhlenkamp | 33/239 |
| 3,137,769 | 6/1964 | Yates et al. | 356/252 |
| 4,020,324 | 4/1977 | Buscher et al. | 89/41 EA |

*Primary Examiner*—Stephen C. Bentley
*Attorney, Agent, or Firm*—Finnegan, Henderson, Farabow & Garrett

[57] ABSTRACT

An aircraft gun sighting system and method for use in executing high angle-off attacks wherein a headup display unit employs a cathode ray tube for projecting sighting indicia on the pilot's sighting panel. The sighting indicia appear as a plurality of straight lines lying along a circular sector on the lower portion of the sighting panel. The circular sector is defined by a center point on the panel representing the muzzle aiming point such that the sighting indicia define a fixed lead angle. Each sighting line represents the position of a hypothetical target travelling in a path which will, one bullet flight time later, intersect the path of a bullet fired by the attacking aircraft. The sighting lines are periodically reset to the outer limits of the circular sector whereupon they move along the sector toward convergence at the line defining the turning plane of the attacking aircraft. Resetting of individual lines is staggered in time so that the lines are spread out along the circular sector and the pilot always sees at least one line on or near the target. The length of the sighting lines is controlled in a manner enabling the pilot to estimate range conditions in order to determine whether sufficient lead angle exists. The pilot maneuvers the attacking aircraft so that any sighting line appears stationary on the target image and commences firing when that condition is observed.

18 Claims, 9 Drawing Figures

AIRCRAFT GUN SIGHT SYSTEM AND METHOD FOR HIGH ANGLE-OFF ATTACKS

BACKGROUND OF THE INVENTION

Heretofore the type of aircraft gun sighting device which has been primarily relied upon for aircraft combat missions has been the so-called lead computing optical sight (LCOS), which has been in use in essentially the same form since the latter portion of World War II. An example of an LCOS system is described in U.S. Pat. No. 2,467,831 issued to F. V. Johnson in 1949.

This type of system provides the pilot with a reticle image on an optical head-up display panel. Through use of collimating optics in the sight system, the image of the reticle is made to appear at infinity in the pilot's field of view. The position of the reticle on the display panel is controlled by a two-axis gyro in a manner which is dependent upon the angular velocity of the line of sight to the target and projectile time of flight to the target. As originally conceived, operation of the LCOS system required the pilot to maneuver the attacking aircraft so that the reticle was fixed on the target for some minimum time. At the same time, an accurate estimate of the range of the target aircraft had to be entered into the system.

When the target is being "tracked" by the LCOS reticle and an accurate target range input is available, the attacking aircraft is properly oriented so that the muzzle velocity vector of its gun (appropriately compensated for gravity drop) is in the plane of the velocity vector of the target and is offset at the correct lead angle. Firing of the gun at this time maximizes the likelihood of achieving a hit on the target. The LCOS can also be used without tracking of the target by firing approximately one bullet time of flight before the reticle intercepts the target. This technique however requires considerable skill on the part of the pilot and is useful only when the reticle pip is brought into the immediate vicinity of the target.

Experience has shown that the LCOS system has a high degree of reliability only when the angle-off (angle at which the velocity vector of the attacking aircraft intersects the line of the velocity vector of the target aircraft) is relatively small (e.g., less than 30°), when the rate at which the attacking aircraft is closing on the target is low, and when a relatively accurate measurement of the target range is available.

Fighter aircraft combat conditions, however, have changed dramatically since the era when the LCOS system was developed and extensively exploited. Air-to-air missile systems generally have replaced guns as the principal aircraft armament in the post-Korean War period, i.e., the late 1950's and 1960's. It was throught that air-to-air missiles would render the need for gun systems obsolete. However, aircraft combat experience during the 1960's demonstrated that certain combat situations could be encountered in which a gun system could be utilized as a highly effective complement to an air-to-air missile system.

In relatively close-in combat, it has been found that a highly maneuverable aircraft with a gun system can obtain an advantage over a higher speed, less manueverable aircraft equipped only with missiles. A situation which has been encountered is one where the higher speed aircraft initially attacks by executing a missile pass. The more maneuverable target aircraft, detecting the missile launch, turns tightly into the direction of the attack, thereby avoiding the missile. Without a gun system the attacking aircraft has no way of further pursuing the tactical advantage he enjoys at that moment.

However, if the attacking aircraft is also equipped with a gun system a significant advantage is gained. Again consider the above-described attack situation. When the target aircraft turns to avoid the missile, the attacking aircraft, still being in a trailing position with respect to the target aircraft, has, for a relatively short period of time, an excellent opportunity to make a gun attack on the target.

However, because of the maneuvering positions of the two aircraft under these conditions, a gun attack can usually be made only at a high angle-off between the attacking and target aircraft. Typically, an angle-off of 90° or more can be experienced. This means that the attack will be characterized by a high rate of change of the line of sight to the target aircraft by a high range closing rate and by a very narrow target opportunity "window".

In such an attack situation an LCOS system is of limited value due to the large angle-off and the extreme dynamics involved. Furthermore, the ability to determine target range through radar tracking under such conditions is highly limited for a number of reasons. A reliable radar lock may not be achievable or maintainable due to the high crossing velocity of the target and, furthermore, it may not be desirable from a security standpoint for the attacking aircraft to emit radar radiation when in such a combat situation.

OBJECTS AND SUMMARY OF THE INVENTION

It is accordingly an object of the present invention to provide an improved optical sighting system and method for accurately aiming the gun or guns of an aircraft during high angle-off attack conditions.

A further object is to provide an improved optical sighting system and method that gives effective performance without accurate target range data.

Another object is to provide an improved optical sighting system and method that permits the pilot to give full visual attention to the target at all times during the attack.

Yet another object is to provide an improved optical sighting system and method that does not require the pilot to maintain a position track between the sight reticle and the target for any minimum period of time.

Still a further object is to provide an optical sighting system and method which is readily adaptable for use in conjunction with a conventional LCOS system.

Additional objects and advantages of the invention will be set forth in part in the description which follows, and in part will be apparent from the description or may be learned by practice of the invention. The objects and advantages of the invention may be realized nd attained by means of the instrumentalities and combinations particularly pointed out in the appended claims.

To achieve the foregoing objects in accordance with a first aspect of the invention, as embodied and broadly described herein, the optical sighting system of the invention comprises a sighting panel presenting a field of view, including a target image, to a gun operator, means for generating data signals representing own aircraft roll rate, pitch rate and yaw rate, display means for presenting sighting indicia on the sighting panel superimposed on the operator's field of view, and control means responsive to the data signals for controlling the operation of the display means, such that the sighting indicia are presented in positions on the sighting panel at a fixed lead angle equidistant from the point thereon defining the aiming point of the aircraft gun, the control means being further operable to cause the indicia to move across the sighting panel along a circular path toward a point of convergence defined by the turning plane of the attacking aircraft.

In accordance with a further aspect of the invention, as embodied and broadly described herein, the optical sighting system of the invention comprises a combining glass sighting panel adapted to operate with a collimating optical reticle image display, the latter being arranged so that a plurality of sighting indicia are projected onto the sight panel to define a plurality of hypothetical target positions displaced from the projected muzzle velocity vector intersection point by substantially the same angular amount. Control means are provided to cause the sighting indicia to move through a circular arc on the sighting panel converging on a line describing the present turning plane of the muzzle vector of the gun.

In accordance with still a further aspect of the invention, as embodied and broadly described herein, the optical sighting system of the invention comprises a target viewing panel, collimating optical projection means for displaying sighting indicia on the panel and display means for generating sighting indicia in the form of a plurality of straight lines having a length determined as a function of the instantaneous turning rate of the attacking aircraft and the size of the target such that stadia ranging can be performed by the pilot of the attacking aircraft by comparing the length of the sighting lines with the fuselage length of the target aircraft.

In accordance with yet another aspect of the invention, as embodied and broadly described herein, a method is provided for generating sighting indicia on a head-up display panel to enable a pilot to execute a high angle-off gun attack on an airborne target comprising the steps of generating data signals representing the roll rate p, pitch rate q and yaw rate r of the attacking aircraft, displaying sighting indicia on the display panel at locations displaced from the point on the panel representing the aiming point of the aircraft gun by the fixed lead angle $\lambda_m$, each of the indicia being positioned on the panel in accordance with selected initial coordinate values $x_o$ and $y_0$ defining $\lambda_m$ in terms of traverse and elevation angular components $\lambda_w = x_o\lambda_m$ and $\lambda_v = -y_o\lambda_m$, respectively, and controlling the positions of said indicia on the panel by varying the $x_o$ and $y_o$ initial coordinate values in accordance with the equation $$\frac{\dot{x}}{y} = p - \frac{(qx - ry)}{\lambda_m}$$

The accompanying drawings, which are incorporated in and constitutes a part of this specification, illustrate one embodiment of the invention and, together with the description serve to explain the principles of the invention.

DETAILED DESCRIPTION OF THE EMBODIMENT

Figure 1:
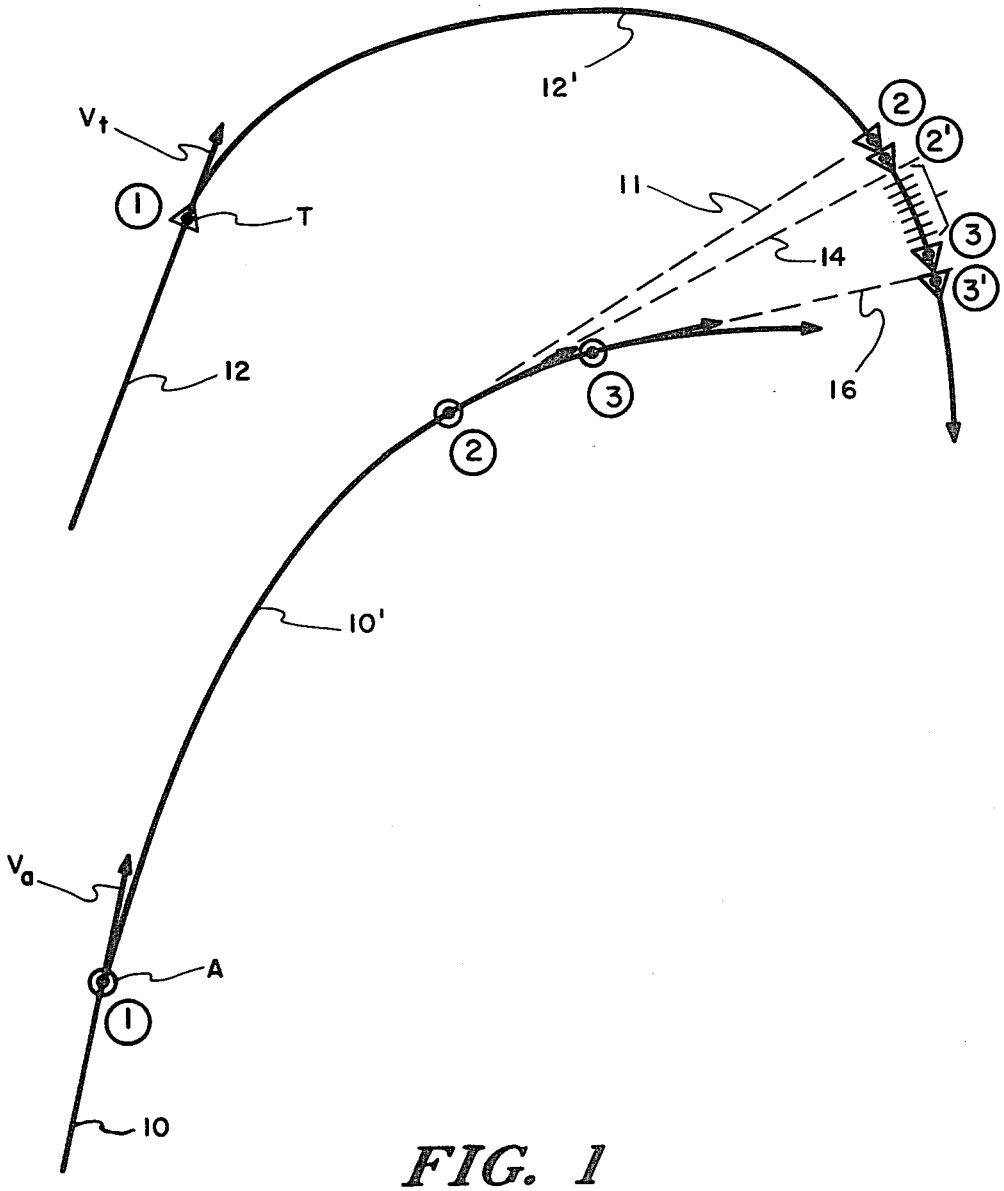
FIG. 1 is a schematic diagram illustrating the flight paths of an attacking aircraft and a target aircraft in a typical combat situation for which the sighting system of the invention is particularly effective.

FIG. 1 shows a schematic diagram illustrating as an example one type of combat situation for which the sighting system of the invention is highly effective. An attacking aircraft A, indicated by the circular symbols, follows a flight path 10 in making a missile pass at target aircraft T, which is following the path 12 and is represented by the triangular symbols. At an initial time 1 the two aircraft are in the positions denoted by the encircled 1's and attacker A has a velocity vector $V_a$ and the target T has a velocity vector $V_t$. At this instant attacker A launches a missile at the target and the pilot of the target aircraft, seeing the launch, puts his aircraft into a tight right turn (represented by flight line 12') in an attempt to increase the angle-off between his velocity vector and that of the missile as much as possible in order to avoid the missile.

In pursuing the attack, aircraft A also turns right as shown at 10' and maneuvers into a position for a high angle-off gun pass using the sighting system of the invention. At time 2 (denoted by the encircled 2's) the target aircraft is crossing almost directly in front of the attacking aircraft and at this time the attacker (viewing the target along line of sight 11), having achieved a proper alignment of the target in the sighting system, triggers a gun burst. The first round of the burst follows path 14 and the final round of the burst follows the path 16. As shown, the first round, fired at time 2, crosses in front of the target's path one bullet flight time interval later at time 2' and the last round, fired at time 3, crosses behind the target one flight time interval later at time 3'. Intermediate rounds intersect the path of the target at points indicated within the bracket S. Thus, the target flies through the burst of fire and since there is a high probability that several hits will occur, significant target damage is likely.

Figure 2:
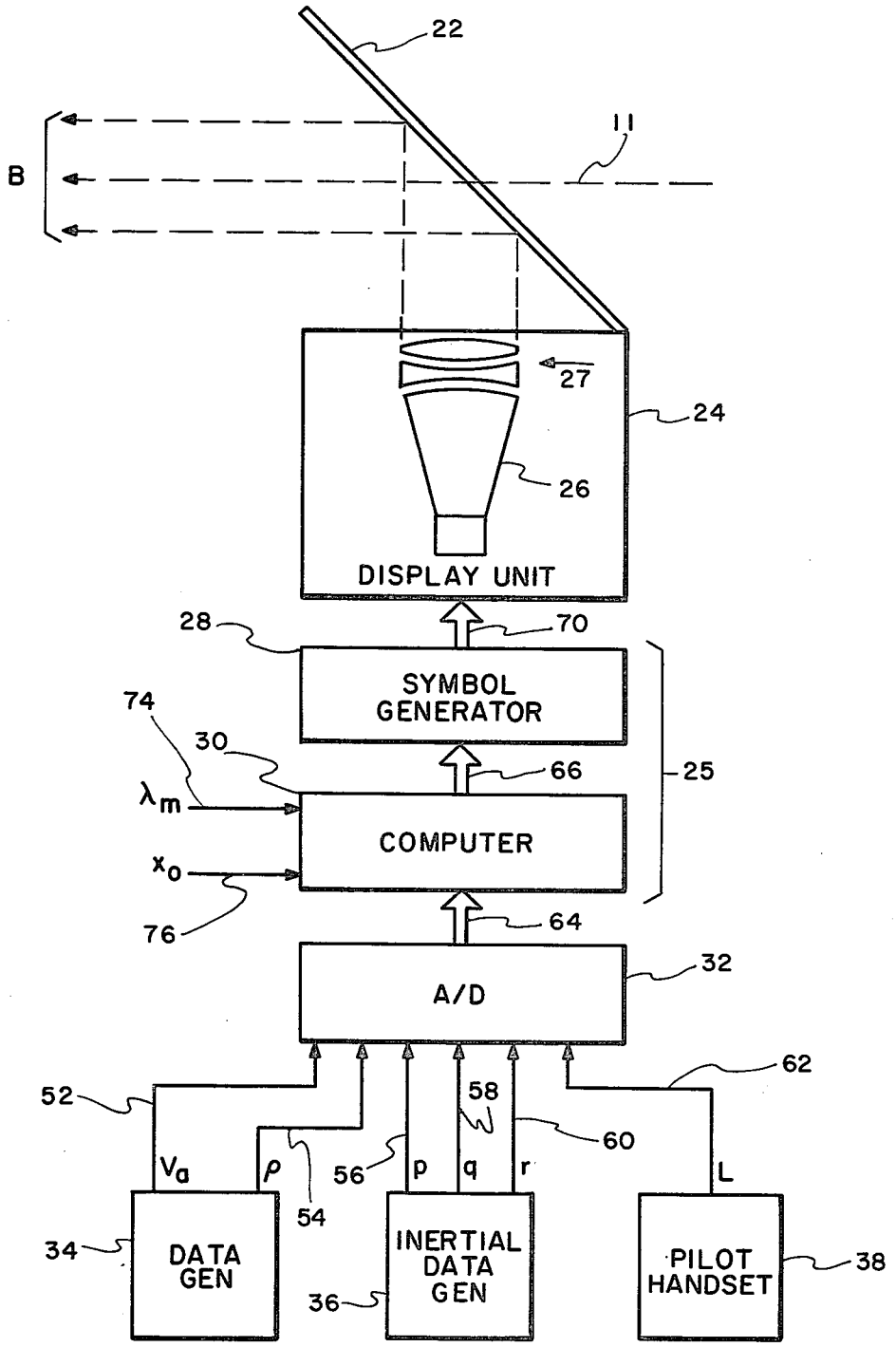
FIG. 2 is a block diagram showing the interrelation of the various components of the sighting system in accordance with one embodiment of the invention.

FIG. 2 shows, in block form, the gun sighting system in accordance with a preferred embodiment of the invention. The pilot (gun operator) located at B is presented with a field of view through a combining glass panel 22 arranged in accordance with a conventional "head-up display" (HUD) configuration. The pilot's field of view includes the line of sight 11 to the target.

A sight display unit 24, including a cathode ray tube (CRT) 26 and collimating optics 27, operates to project sighting indicia onto the pilot's field of view via the combining glass 22. The collimating optics 27 serve to focus the indicia images so that they appear to the pilot to be emanating from infinity, i.e., from the area of the target. This collimating arrangement is well-known in connection with HUD systems and operates to eliminate parallax problems and permits the pilot the freedom to move his head within the sight field of view without degrading the accuracy of the system.

The display unit 24 projects sighting indicia in accordance with control signals received from a control unit 25 including a symbol generator 28 and a digital computer 30. The latter receives inputs through an analog-to-digital converter unit 32 from a plurality of data input sources 34, 36 and 38.

Data generator 34 supplies signals to A/D unit 32 over lines 52 and 54 representing own aircraft air speed $V_a$ and relative air density $\rho$, respectively. These signals are encoded by A/D converter 32 and fed to computer 30 via data bus 64.

An inertial data generator 36 supplies signals representing own aircraft roll rate p, pitch rate q and yaw rate r on lines 56, 58 and 60, respectively. These signals are also encoded by A/D converter 32 and fed to computer 30 over data bus 64. For reasons explained hereinafter, the signal defining pitch rate q is never allowed to drop below a value representing some minimum limit such as two milliradians per second.

Also, the pilot utilizes a hand set unit 38 to supply a signal L on a line 62 representing the type of target, e.g., MIG 21. This signal is also encoded by A/D converter 32 and fed to computer 30 via data bus 64.

Computer 30 also receives digitally encoded inputs $\lambda_m$ and $x_o$ representing, respectively, the fixed lead angle F (FIG. 3) and the initial $x_o$ coordinate of the starting position of the sighting lines on the sighting panel. The computer transmits outputs via data bus 66 to the symbol generator 28 which in turn feeds signals via bus 70 to operate the beam deflection and control amplifiers of the display unit whereby the sighting indicia are displayed on the CRT 26.

Figure 3:
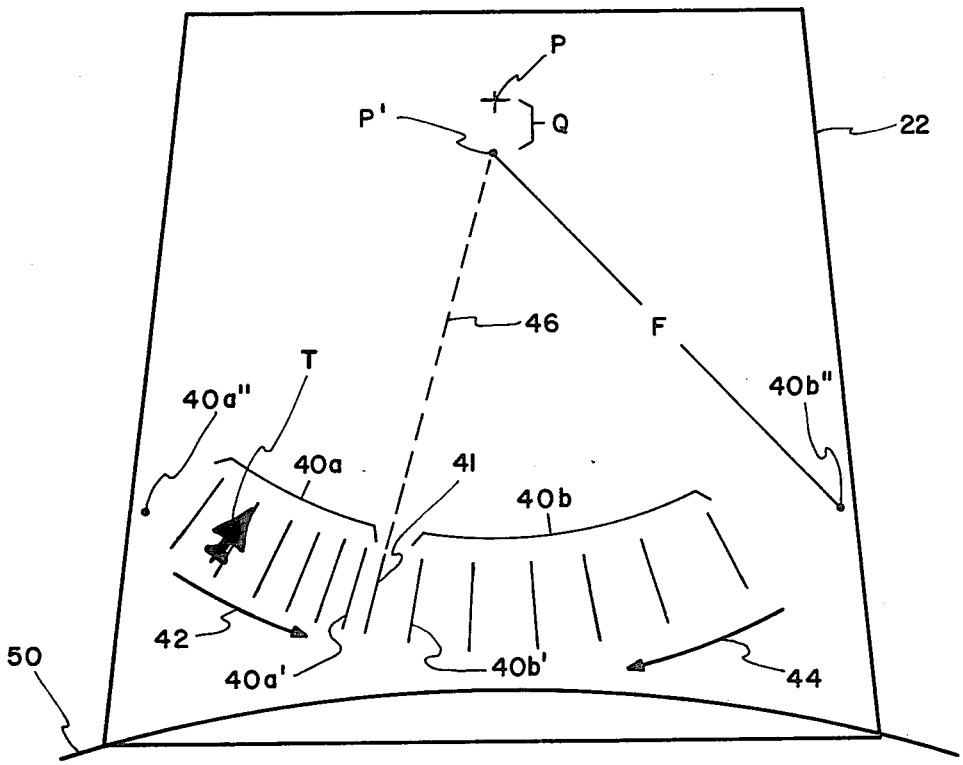
FIG. 3 is a schematic diagram illustrating the sighting panel and sighting indicia of the invention and depicting the pilot's field of view through the panel during the attack situation described in connection with FIG. 1.

FIG. 3 illustrates the field of view presented to the pilot through combining glass 22. The pilot views the target T together with a plurality of radial sighting indicia 40*a*, 40*b* and 41. The view shown in FIG. 3 is that presented to a pilot looking forward over the nose 50 of the aircraft.

The sighting indicia are defined by a plurality of lines positioned on radii emanating from a point P' representing the aiming point of the aircraft gun. The cross P represents the actual gun bore sight or aiming point. This is the point where the gun muzzle velocity vector intersects a plane located a predetermined distance in front of the aircraft. The point P' is offset by distance Q from the point P to correct for gravity drop, i.e., the effect of gravity on the gun ballistic projectiles. The broken line 46 represents the present turning plane of the gun.

Sighting indicia 40*a*, 40*b* and 41 are projected on the combining glass 22 along an arc which is a segment of a circle centered at P'. The indicia 40*a* and 40*b* are controlled to move along the circular path in the direction of arrows 42 and 44 and converge on the center line 41 lying on the line 46 representing the turning plane. In the embodiment herein described there are six left-hand lines 40*a*, six right-hand lines 40*b* and one center line 41.

As will be described in detail hereinafter, the display and control system utilized in accordance with the exemplary embodiment described herein operates to regenerate the sighting lines at the outer ends of the circular segment after they have moved toward the point of convergence for a predetermined time interval.

The pilot sees only the target image and sighting indicia 40*a*, 40*b* and 41. The broken lines, arrows 42, 44 and the various symbols shown in FIG. 3 are used only as an aid to an understanding of the invention and do not actually appear on the display panel.

Each of the sighting lines represents a hypothetical target located at the fixed gun lead angle represented by the distance F in FIG. 3. To properly align the target T in the sight, the operator must maneuver the aircraft so that any one of the lines 40*a*, 40*b* or 41 remains stationary on the target. That is, when there is no relative motion between a sighting line and the target image, the lateral gun aiming error is zero. Firing the gun at this time and continuing the burst for a short time as the target moves up the sight toward the point P', directs a sequence of rounds which initially intersect the target path in front of the target and then strafe through the target as the target line of sight angular rate exceeds that of the attacking aircraft.

In accordance with a further feature of the invention, as hereinafter described in detail, the length of the lines 40*a*, 40*b* and 41 is adjusted in accordance with the attacking aircraft's own turn rate. This provides the pilot with an indication as to whether sufficient lead angle exists. That is, if the length of the lines 40*a*, 40*b* and 41 exceeds the length of the target fuselage, the target velocity is too high and the attacking aircraft cannot maneuver to a point where sufficient lead angle will exist. In such a situation the pilot should not initiate firing.

Figure 4:
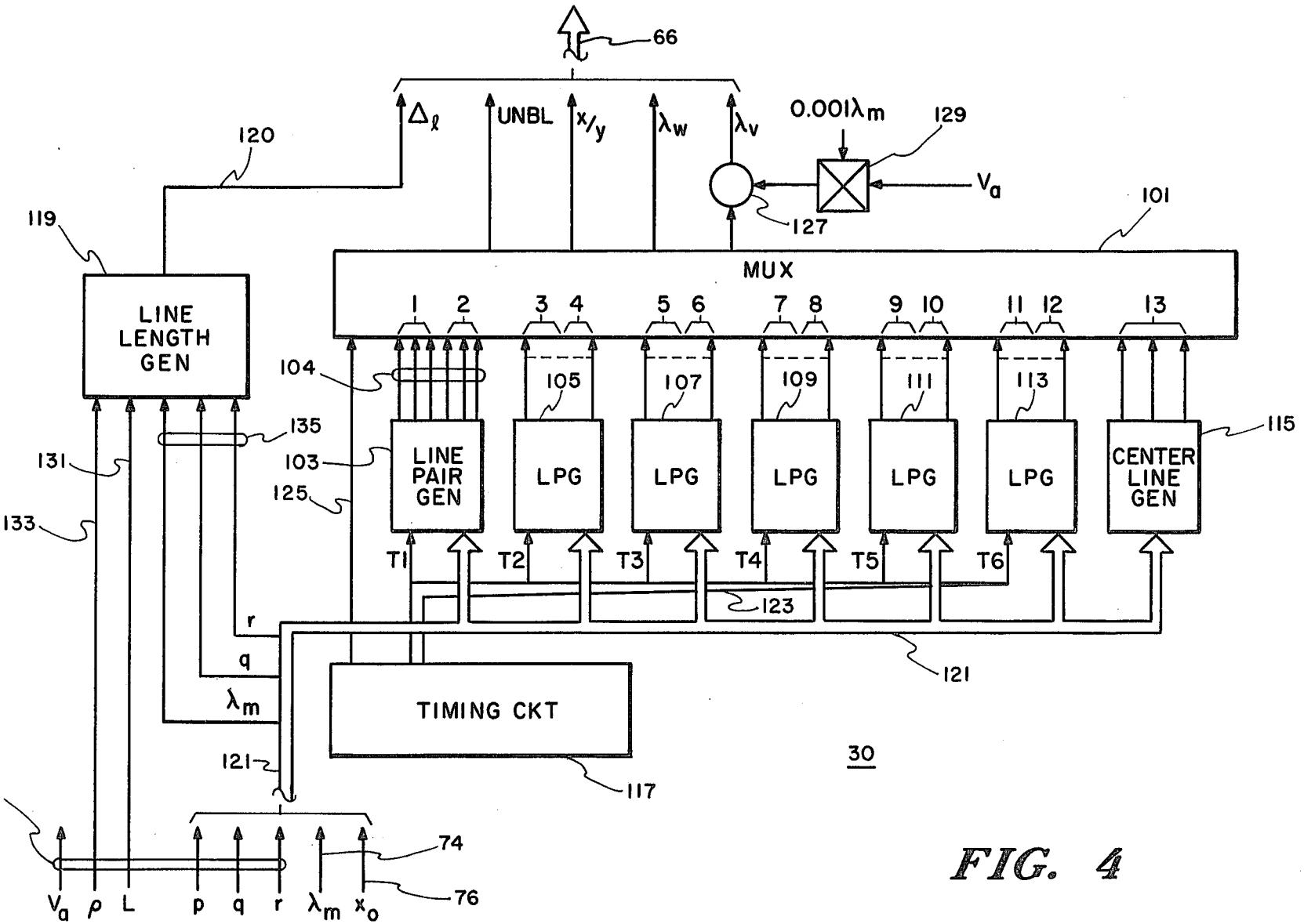
FIG. 4 is a schematic diagram illustrating the computer 30 of FIG. 2.

The circuits of computer 30 are illustrated in the schematic diagram of FIG. 4. The computer comprises a plurality of line pair generators 103, 105, 107, 109, 111 and 113 for generating the sighting lines (indicia) 40*a* and 40*b* and a center line generator 115 for generating the sighting line 41. The intertial data signals p, q and r supplied on data bus 64, together with the inputs $\lambda_m$ and $x_o$ supplied on input lines 74 and 76 are fed via data bus 121 to the seven line generating circuits.

A timing circuit 117 is provided to generate the six timing signals T1–T6 which are transmitted to the six line pair generators via data bus 123. A multiplexer 101 is controlled by a timing signal supplied on line 125 to sequentially sample the outputs on the line generators and to provide the four output signals UNBL ("unblank"), x/y, $\lambda_x$ and $\lambda_y$ via the output data bus 66 to the symbol generator 28.

Each of the line pair generators 103, 105, 107, 109, 111 and 113 is identical and operates to generate digitally encoded output signals defining the x and y coordinates of the lower ends of a pair of sighting lines together with a signal representing the slope of each respective line. These output signals are provided on six output lines emanating from each line pair generator, e.g., the lines 104 shown for generator 103.

The center line generator 115 provides three digital output signals representing the x and y coordinates of the lower end of the center sighting line 41 (FIG. 3) and a signal x/y representing the slope of the line.

Multiplexer 101 periodically samples each group of three output lines representing one sighting line and supplies three output signals x/y, $\lambda_w$ and $\lambda_y$ in response thereto over output bus 66. The multiplexer samples the line generator output signals in the sequence indicated by the signal groups 1 through 13 shown in FIG. 4. Each sampling operation controls the tracing of one sighting line by the CRT in display unit 24.

Computer 30 additionally includes a line length generator circuit 119 which provides an output signal $\Delta_1$ on an output line 120 which is also fed to the symbol generator 28 via data bus 66. Line length generator 119 operates in response to digital input signals provided on lines 131, 133 and 135 representing, respectively the target type signal L, relative air density $\rho$ and the three parameters $\lambda_m$, q and r.

Multiplexer 101 is controlled by a timing signal provided on line 125 to sample the line generation signals at a rate of approximately 50 times per second, i.e., each group of three outputs is sampled for a period of approximately twenty milliseconds. Each time a new set of signals is provided at the output of the multiplexer, the CRT in display unit 24 is controlled to generate a single radial line representing one of the sighting lines. The starting point (lower end) of the line is determined by the coordinate data signals $\lambda_w$ and $\lambda_v$, the slope of the line is controlled by the signal x/y and the length of the line is controlled by the $\Delta_1$ signal. The unblank signal, which is also transmitted via data bus 66 to the symbol generator 28, is provided to control the turning on of the CRT beam.

Figure 5:
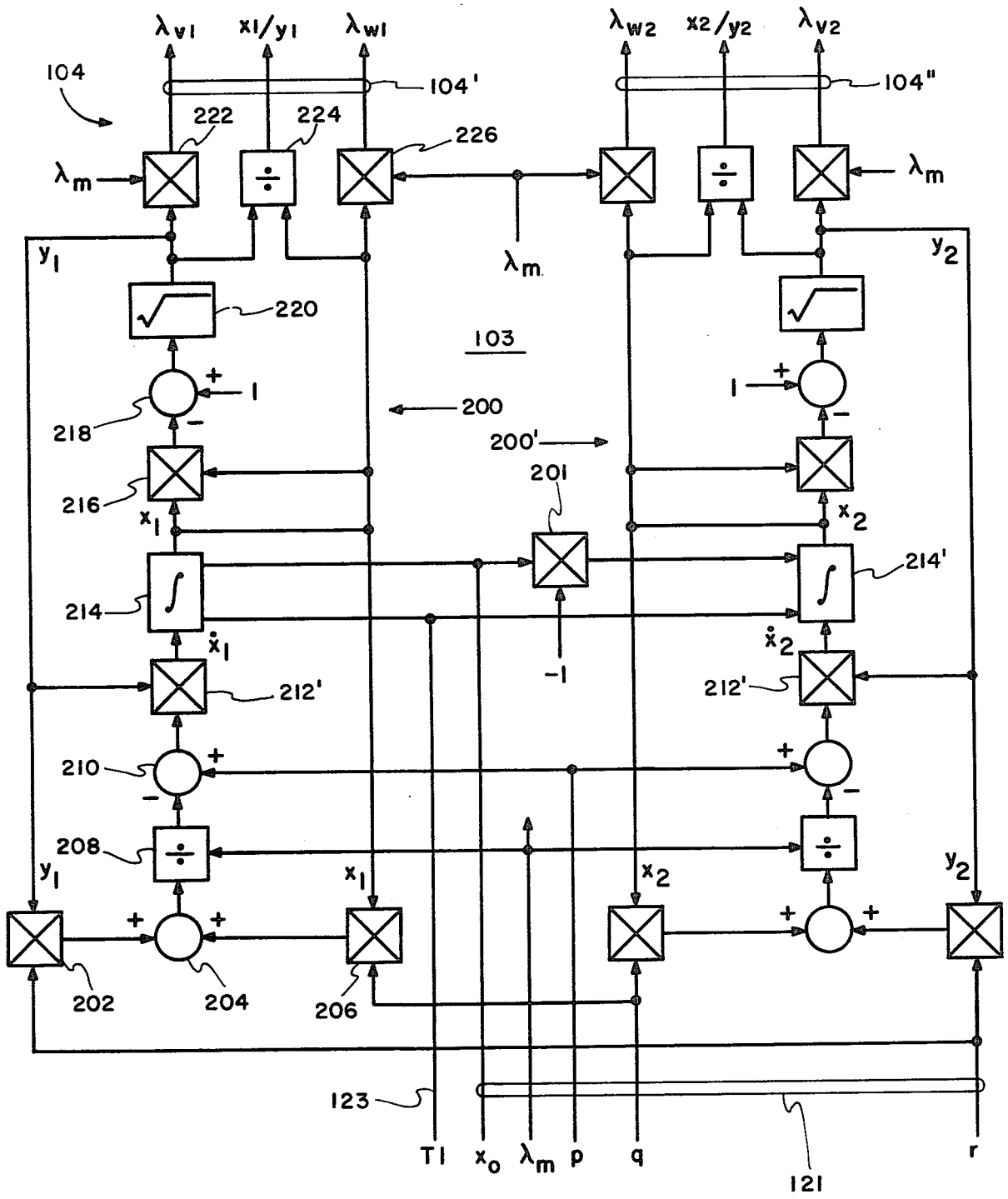
FIG. 5 is a schematic diagram representing the circuits of the line pair generator 103 shown in FIG. 4.

As mentioned previously, each of the line pair generators is identical such that it is necessary only to describe the single line pair generator 103. The latter is shown in FIG. 5 and comprises a pair of identical line generating circuits 200 and 200'. The inputs to the circuit include the five signals p, $\lambda_m$, $x_o$, q and r received on the data bus 121. In addition, timing signal T1 is received on line 123 from timing circuit 117. Of the six output lines 104 extending from generator 103 a first set 104' defines one of the left-hand sighting lines 40*a* (FIG. 3) and a second set 104'' defines the corresponding sighting line 40*b* on the right-hand side of center line 41. For example, the two sighting lines generated by circuit 103 may be the lines 40*a'* and 40*b'* shown in FIG. 3.

Looking at the line generating circuit 200 (FIG. 5) which generates the sighting line 40*a*, it is seen that the circuit comprises a pair of multiplication circuits 202 and 206 which are respectively arranged to multiply the yaw rate signal r by a signal $y_1$ and the pitch rate signal q by a signal $x_1$. The respective products of the multiplications performed by circuits 202 and 206 are fed to an adder circuit 204 and the sum generated thereby is fed into a division network 208 which also receives as an input the signal $\lambda_m$ and which produces a quotient signal $(qx_1 + ry_1)/\lambda_m$ at its output.

The resultant quotient signal is fed to the negative input of an adder circuit 210 and is subtracted from the roll rate signal p. The difference is then multiplied in multiplying network 212 by $y_1$ and the product represents $\dot{x}_1$, the first time derivitive of the desired output signal $x_1$.

The signal representing $\dot{x}_1$ is integrated in an integration circuit 214. The output quantity $x_1$ is fed back to the input of multiplier 206 and is also presented to an input of a multiplier 226 where it is multiplied by the quantity $\lambda_m$ to generate the output signal $\lambda_{w1}$. The latter quantity defines the traverse component of the sighting angle existing between the gun aiming point P' (FIG. 3) and the lower end of the sighting line 40*a'*. This can be thought of as the "x" coordinate of the starting point of the sighting line (thinking of the sighting panel in terms of a rectilinear grid with the intersection of the x and y axes located at the aiming point P').

The "y" coordinate defined by $\lambda_{v1}$ (the elevation component of the sighting angle) is generated by squaring the $x_1$ quantity in a multiplying circuit 216 and by subtracting the output $(x_1^2)$ from unity in adder network 218. The quantity generated at the output of the latter circuit is $y_1^2$ which is converted to $y_1$ by a square root circuit 220.

The $y_1$ quantity is, as previously described, fed back to multiplier 202 and to an input of multiplier 212. $y_1$ is multiplied by $\lambda_m$ in multiplier 222 and the resultant product generated on output line 104' represents the quantity $\lambda_{v1}$.

A dividing network 224 receives the $x_1$ and $y_1$ signals at its inputs and generates the ratio $x_1/y_1$ which is also fed to the multiplexer over output lines 104'. The ratio $x_1/y_1$ represents the slope of the sighting line 40*a'*.

Timing pulse T1 received via line 123 operates to reset integrator 214 at periodic intervals. This causes the sighting line to be regenerated at an initial starting point at the left side of the sighting panel as represented by the position of point 40*a''* shown in FIG. 3. The coordinates of the position at which the sighting line is regenerated are defined by the predetermined quantity $x_o$ which is presented to the line pair generators over data bus 121.

The magnitude of resetting coordinate $x_o$ may be entered into the computer manually through appropriate control switches (not shown) or it may be predetermined and stored in a memory portion of the computer.

Sighting line 40*b'*, which is also generated by circuit 103 and is located on the opposite side of the center sighting line 41 (FIG. 3) is generated by circuit 200' in exactly the same manner as described above for line 40*a'*. The reset coordinate value $x_o$ is multiplied by $-1$ by multiplier 201 prior to being inserted into integrator 214'. The $-x_o$ input defines a reset coordinate location at the far right side of the sighting panel shown at the point 40*b''*.

Referring back to FIG. 4, it is seen that center line generator 115 has only three output lines and does not receive a timing pulse input from timing circuit 117. The reason for the latter is that the center sighting line 41 (FIG. 3) is never reset. Since the center line generator defines only a single sighting line it employs only one line generator circuit corresponding to the circuit 200 shown in FIG. 5 and this accounts for the three output lines instead of six.

The integrating network (corresponding to integrator 214 of circuit 200) which is used in generator 115 does not receive the reset coordinate $x_o$. Instead, its initial value is set at zero so that the x coordinate value defining the initial location of the lower end of center line 41 is zero, i.e., it defines a point directly in the center of the sighting panel.

The circuits 200 and 200' generate the control signals $\lambda_w$, $\lambda_v$ and x/y by processing the p, q and r input signals in accordance with the equation $$\frac{\dot{x}}{y} = p - \frac{(qx + ry)}{\lambda_m}$$

to derive values for x and y. $\lambda_w$ is generated by multiplying the x value by $\lambda_m$ and $\lambda_v$ is produced by multiplying the y value by $\lambda_m$.

Figure 9:
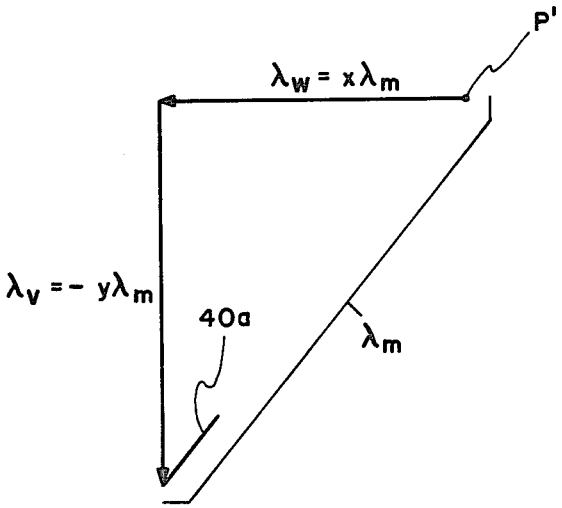
FIG. 9 is a vector diagram showing the relationship of the x and y coordinate values derived by the circuit of FIG. 5 to the angular display coordinates $\lambda_w$ and $\lambda_v$.

As previously noted, $\lambda_w$ and $\lambda_v$ are traverse and elevation components of the angle $\lambda_m$ defining the position of the lower end of a particular sighting line. This is shown in FIG. 9. The relationship of the x and y coordinate values to the vector coordinates $\lambda_w$ and $\lambda_v$ is also shown. The angle $\lambda_m$ is the same as the distance F shown in FIG. 3.

The development of the above equation is given in detail subsequently.

The output lines of each of the line pair generators 103, 105, 107, 109, 111 and 113 and center line generator 115 are connected to the input of multiplexer 101. The multiplexer is controlled by a scanning signal generated by timing circuit 117 and presented over line 125 to control the multiplexer to periodically sample each set of three input signals defining a single sighting line. As shown in FIG. 4, there are thirteen sets of such signals numbered 1 through 13. The multiplexer scans these signal sets in a repetitive sequence 1–13, 1–13, etc. The scan rate, under control of the timing signal presented on line 25, is relatively rapid in comparison with the rate at which the magnitude of the line generation signals change. As previously stated, the line generation signals may be scanned at fifty hertz.

Each time the multiplexer 101 samples a set of line generation signals it transfers the values of those signals to the three output lines x/y, $\lambda_w$ and $\lambda_V$ of multiplexer output bus 66. These three signals, which remain at the output of multiplexer 101 for approximately 20 milliseconds (one fifieth of a second) are transmitted via data bus 66 to symbol generator 28 which in turn controls the beam control amplifiers of the CRT in display unit 24 to cause a sighting line to be generated in a location on the display determined by the x/y, $\lambda_w$ and $\lambda_v$ signals.

It is seen that the multiplexer scanning sequence causes the thirteen sighting lines to be generated in a pair sequence with the left-hand sighting line of each pair being traced first and then immediately after that the righthand sighting line of that pair is traced on the opposite side of center line 41.

Figure 7:
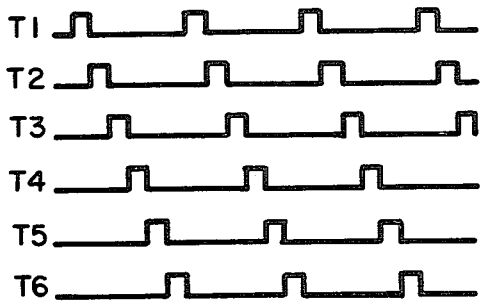
FIG. 7 is a timing diagram showing the interrelation of the timing signals T1–T6 employed to control the six line pair generators shown in FIG. 4.

FIG. 7 shows the sequence of timing pulses T1–T6 which controls the resetting of the twelve sighting lines **40*a* and 40*b*. When operation of the system is first initiated, the integrating circuits of all the line generators have an initial value of zero and thus all thirteen sighting lines are generated in the zero display position in the center of the sighting panel and thus are traced by the CRT beam on top of one another and on top of the center line 41** in the center of the panel at the distance F below the gun aiming point P' (FIG. 3).

However, when timing pulse T1 is generated (FIG. 7) it causes the initial coordinate values $x_o$ and $-x_o$ to be set into the integrators 214 and 214' (FIG. 5) associated with the line pair generator 103 and this causes the line pair controlled by that circuit to be traced at the left and right outer edges of the display panel on the next cycle of multiplexer 101. Thereafter, on each ensuing cycle of the multiplexer, the same line pair generated by circuit 103 will be retraced in the same locations at the outer bounds of the display panel (assuming that the aircraft is flying in a straight, level path and that the values of p and r remain at zero while q remains at its lower limit value of 2 mrad./sec.).

When timing pulse T2 comes up, the integrating circuits of line pair generator 105 are reset to $x_o$ and $-x_o$ and the pair of lines controlled by line generator 105 is shifted to the outer bounds of the sighting panel and will be traced on top of the lines generated by circuit 103. As each timing pulse T3 through T6 occurs, the sighting lines produced by generators 107, 109, 111 and 113 are similarly shifted to the outer positions on the sighting panel and will be traced on top of the other sighting lines. Only the center line produced by generator 115 will continue to be traced at the zero coordinate point location at the center of display.

As previously stated, the above discussion assumes that the signals received from the inertial data generator representing aircraft roll rate p and yaw rate r remain at zero while pitch rate q remains at its lower limit value of 2 mrad./sec. If q was not clamped at a lower limit value but was instead allowed to go to zero along with p and r, the computer outputs would cease to have significance and the sighting lines would simply drift in meaningless fashion, confusing the display. The q output may be set at the required lower limit value through use of a clamping diode or similar circuit device in data generator 36 to prevent the level of the q signal from dropping below a magnitude representing the desired lower limit value.

As the pilot maneuvers the aircraft to align the image of the target in the appropriate position on the sighting panel, the values of p, q and r will be other than zero. Values for $\dot{x}_1$ and $\dot{x}_2$ will appear at the outputs of multipliers 212 and 212' in the circuits 200 and 200', respectively (FIG. 5) of the seven line generators and the integrating networks in those circuits will accumulate values for $x_1$ and $x_2$, respectively. The operation of circuit 200 of line generator 115 is such as to cause the coordinate location of the center sighting line 41 to move to the left or right on the sighting panel so as to define the turning plane of the aircraft.

The sighting lines generated by circuits 103, 105, 107, 109, 111 and 113 travel across the sighting panel from the outer boundries of the display toward the center line 41 and converge on the position of the center sighting line. Since the resetting of the integrating circuits 214 and 214' of the six line pair generators 103, 105, 107, 109, 111 and 113 is done on a staggered basis by the timing signals T1–T6, the six pairs of sighting lines **40*a* and 40*b* will be spread out from one another as they move across the sighting panel. Each time one of the timing signals T1–T6 occurs, the pair of lines controlled by that signal is reset back out to the outer bounds of the display and again starts moving inwardly toward center line 41. If the line pairs were not periodically reset in this fashion, they would all merge with center line 41** and only a single sighting line would appear on the sighting panel.

Referring to FIG. 4, it is seen that the value of $\lambda_v$ which is fed by multiplexer 101 to the symbol generator 28 is factored through an adder circuit 127 and has added to it the output of a multiplier 129 which produces the product of $V_a$ (air speed of own aircraft) times a constant value 0.001 $\lambda_m$. This factor compensates the y (elevation) coordinate values $\lambda_v$ for gravity drop, and this offsets the sighting lines by the vertical distance Q shown in FIG. 3. The constant 0.001 $\lambda_m$ is empirically determined and has been found to operate satisfactorily for a wide range of flight conditions. While it might not seem that an offset introduced in the elevation component would by itself effectively compensate for gravity drop, it has been found in practice and verified analytically that such an offset in the elevation component is fully effective without the need for traverse compensation.

The computer circuit 30 also transmits to the symbol generator 28 over data bus 66 an unblanking signal UNBL and a line length signal $\Delta_1$. The unblanking signal is a positive going pulse which is generated by multiplexer 101 each time a new set of line coordinate values appears at the output thereof. UNBL is used by symbol generator 28 to unblank the beam of CRT 26 whereupon the trace of a sighting line on the display is initiated UNBL is generated by multiplexer 101 at a slightly later time than the line coordinate control signals $\lambda_w$ and $\lambda_y$ and x/y to allow time for the CRT deflection circuits to settle out before the line trace is initiated. Line length signal $\Delta_1$ controls the symbol generator 28 to set the unblanking interval of the CRT beam for each line trace, whereupon the length of the sighting line traced by the beam is controlled.

Figure 6:
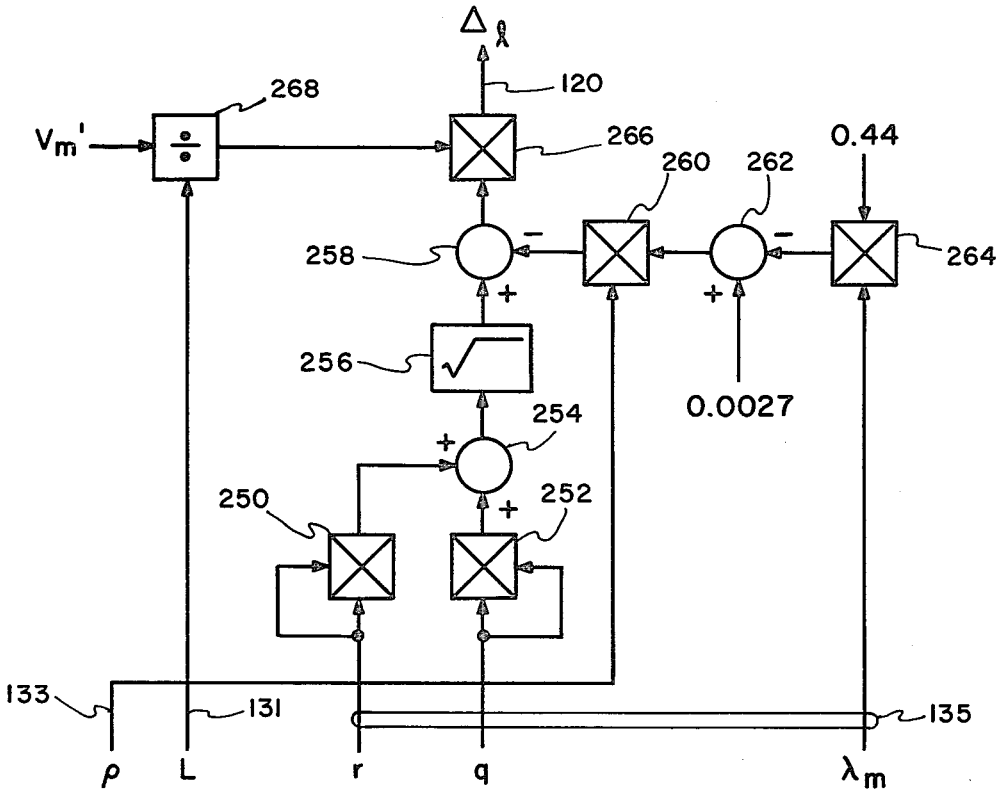
FIG. 6 is a schematic diagram illustrating the circuits of the line length generator 119 shown in FIG. 4.

The line length generator circuit 119 is shown in detail in FIG. 6. The inertial data input signals r and q, received on input lines 135, are squared by a pair of multipler circuits 250 and 252, respectively, and the resultant values of $r^2$ and $q^2$ are summed by adder network 254. A square root circuit 256 computes the square root of the resultant sum of the squares and the output value is summed in an adder 258 with a negative quantity generated by multiplier 260.

Multiplier 260 calculates a factor $\rho$ (0.0027–0.44 $\lambda_m$). The quantity within the parentheses is computed by an adder network 262 and a multiplier network 264 as shown in FIG. 6.

Adder 258 thus calculates an output representing $\sqrt{R^2 + q^2} - \rho$ (0.0027–0.44 $\lambda_m$). This signal is multiplied in multiplier 266 by a quotient signal generated by divider circuit 268 and the resultant output signal generated on line 120 represents the line length control signal $\Delta_1$. Divider circuit 268 computes the value $V_m'$ wherein $V_m'$ represents the muzzle velocity of the aircraft gun divided by 0.91 and is a predetermined, fixed constant. The signal L, as previously described, is selected by the pilot in accordance with the type of target under attack and represents the fuselage length of the target aircraft.

Symbol generator 28 (FIG. 2) is a conventional control unit used with HUD systems employing CRT display units. The function of the symbol generator is to convert the digital data signals generated by computer 30 into appropriate analog voltage levels for controlling the CRT beam control amplifiers in display unit 24. Symbol generator 28 performs such standard functions as correction for pincushion distortion, etc.

The inertial data generator circuit 36 shown in FIG. 2 may be a conventional three-axis gyro inertial unit. As previously discussed, the circuit providing the q (pitch rate) signal is clamped to a minimum signal value representing a lower limit such as 2 mrad./sec. Data generator 34 which produces signals for $V_a$ and $\rho$ representing, respectively, own aircraft airspeed and relative air density may also be provided in accordance with available instrumentation packages. Analog-to-digital converter 32 is also a conventional, available unit.

The functions of the digital data processing circuits of computer 30 described above in connection with FIGS. 4, 5 and 6 may be implemented by a programmed general purpose digital computer. For example, the line generation circuit 200 shown in FIG. 5 employs the five standard mathematical subroutines of multiplication, addition, division, square root and integration. These functions may be readily programmed into any general purpose scientific computer. The data transfer and storage functions necessary for performing the multiplex scan and for processing the data in the sequence of operations employed in the line generation circuits 200 may be performed by appropriate selection and use of the computer memory circuits. Of course, in view of the environment of the present invention, it is desirable to employ a compact, ruggedized computer of the type suitable for airborne applications. It is fully within the skill of the ordinary programmer familiar with such a computer to program the computer to carry out the mathematical and other data processing functions of the circuits shown in FIGS. 4, 5 and 6.

System Operation

To utilize the sighting system of the invention, the pilot, prior to engaging a target in a high angle-off pass, turns the system on through an appropriate control panel switch and keys in through his handset the signal L identifying the anticipated target type. The pilot maneuvers the attacking aircraft so that the target image T (FIG. 3) appears in the sighting panel 22 just over the nose of the aircraft. Display unit 24 is controlled by the computer 30 in accordance with the prevailing flight dynamics as measured by the signals p, q and r so that the center sighting line 41 shifts to the left (assuming a right turn by the attacking aircraft as shown in FIG. 3). The other sighting lines **40*a* and 40*b* move across the panel in the directions indicated by arrows 42 and 44 with the lines 40*b*** moving at a faster rate and distributed in a more spread-out pattern.

When the pilot observes that any one of the sighting lines overlays any portion of the target and appears to be equal to or shorter than the length of the target and further has little or no apparent lateral motion with respect thereto, firing may be initiated and the attack sequence previously described in connection with FIG. 1 is executed.

In effect, each of the sighting lines appearing on the sighting panel represents a hypothetical target which is moving in a path which will intersect the path of a bullet fired from the attacking aircraft one bullet flight time interval later. When any one of the sighting lines appears stationary relative to any portion of the target image, lateral gun aiming error is effectively zero. Similarly, lateral gun aiming error is zero when any two sighting lines appear to be converging toward a common point on the target. In either of these situations the pilot can initiate a burst of fire with a high probability of hitting and inflicting significant damage on the target. If the pilot keeps the target in the sight long enough the target image will fall into registration with center sighting line 41. However, as discussed above, this condition is not necessary to achieve a hit.

In a high angle-off attack the target opportunity lasts only a few second so that the pilot should fire as soon as he observes zero relative motion between the target and the sighting line overlaying the target. By using the length of the sighting line as a reference, the pilot can effectively determine if the proper range conditions exist. If the length of the sighting line exceeds the apparent length of the target, firing should not be initiated since the fixed lead angle $\lambda_m$ built into the sight will be insufficient and the rounds will pass behind the target. The use of this type of stadia ranging with the system of the invention is effective for the high attack-off situation described herein since the pilot fires a burst of projectiles which are distributed in the plane of the target's motion and strafe through the target in a manner described previously in connection with FIG. 1. Thus exact estimation of target range is unnecessary.

From the above it is seen that the operation of the gun sighting system of the invention provides several distinct advantages and improvements over prior art systems:

(1) The pilot is provided with an instantaneous measure of lateral gum aiming error which is critical in a high closing rate gunnery pass;

(2) Longitudinal control dynamics are comparable to those of a fixed sight so that maximum lead angle can be accurately sustained up to the limits of aircraft rate of turn;

(3) An appropriate sighting reference is always located on or very near the actual target. This provides two important advantages, first the pilot is allowed to focus on the target within narrow foveal limits in order to best counter any target evasive moves, and in order to exercise precision control. This can be accomplished without compromise since a reference (sighting line) is within foveal vision limits independent of the degree of lateral gun error. Second, range error, or rather lead angle error for the existing range is effectively estimated by comparison of the length of the sighting lines against the length of the target image. In accordance with the invention, stadia range estimation is effected by use of fuselage length of the target which is a more accurate reference for large angle-off attacks than is wing span.

(4) No adjustments are required to accomplish stadia ranging during an encounter.

(5) No radiative ranging or tracking devices are required and the system is thus difficult to countermeasure.

(6) No lock-on of any automatic ranging or tracking devices is required.

As thus seen from the preceding description, the system of the invention comprises a sighting panel presenting a field of view, including a target image, to a gun operator. As here embodied the sighting panel includes the combining glass 22 (FIGS. 2 and 3). Further, the invention includes means for generating data signals representing aircraft roll rate, pitch rate and yaw rate. In the present embodiment this element includes the inertial data generating unit 36.

As further provided, the system of the invention includes display means for presenting sighting indicia on the sighting panel superimposed on the pilot's field of view. As here embodied, the display means includes display unit 24.

Additionally, the invention comprises control means responsive to the data signals for controlling the operation of the display means such that the sighting indicia are presented in positions on the sighting panel at a fixed lead angle equidistant from a point thereon defining the aiming point of the aircraft gun, the control means being further operable to cause the indicia to move across the sighting panel along a circular path toward a point of convergence defined by the turning plane of the aircraft. As here embodied, the control means includes the computer 30, which functions as a calculating means, and symbol generator 28 which operate in response to the p, q and r inertial data inputs to supply signals to the display unit to control the generation of the sighting lines 40*a*, 40*b* and 41.

MATHEMATICAL THEORY UNDERLYING THE DESIGN OF COMPUTER CIRCUITS

Line Generation Circuit 200

The following is a description of the mathematical theory underlying the design of the line generating circuit 200 and its counterpart circuits in the several line generators.

Figure 8:
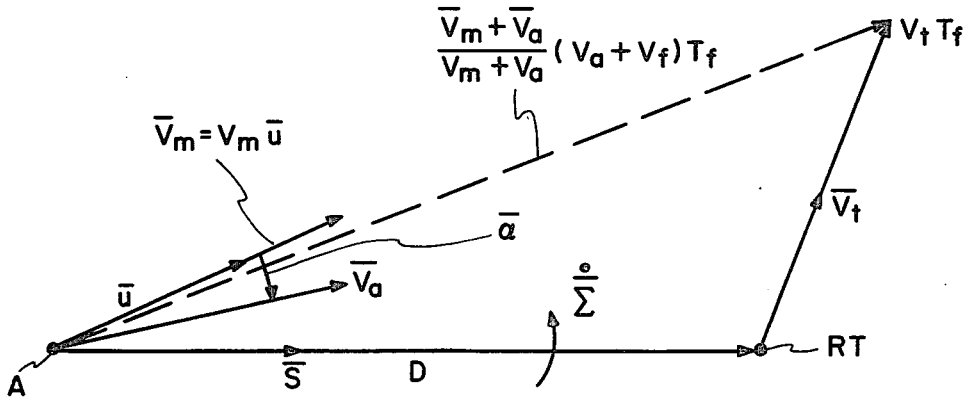
FIG. 8 is a vector diagram useful in understanding the development of the mathematical theory underlying the design and operation of the line generating circuits of FIG. 5.

FIG. 8 is a vector diagram illustration of the kinematic lead for an assumed reference target RT (i.e., a sighting line) having constant velocity, $V_T$. It is assumed that angle off is sufficiently large so that any target acceleration is directed, for the most part, along the line of sight A-RT between the attacking aircraft A and the reference target RT. Neglect of target acceleration is not a major limitation since the effects of target acceleration are sensitive to range, which will not be known accurately, and all these effects will be accommodated by distributing the firing burst in the plane of the problem. The effects of gravity have been neglected in FIG. 8. This correction is conveniently made as described previously by introducing the constant, empirically determined "gravity drop" offset $V_a$ ($10^{-4}$ $\lambda_m$) into the $\lambda_v$ signal at the output of multiplexer 101 (FIG. 4).

In FIG. 8 the following symbols are used:

$T_f$ = bullet time of flight to target
$\overline{V}_t$ = velocity vector of reference target
$\overline{V}_a$ = velocity vector of attacking aircraft
$\overline{\alpha}$ = gun angle of attack
$\overline{S}$ = a unit vector along line of sight A-RT
$\overline{V}_m$ = muzzle velocity vector = $V_m u$
$V_f$ = average bullet velocity relative to attacking aircraft
D = range to RT
$\overline{u}$ = unit vector along gun bore axis The following relationships are apparent from inspection of FIG. 8:

$$D\overline{S} = \frac{\overline{V}_m + \overline{V}_a}{V_m + V_a}(V_a + V_f)T_f - \overline{V}_t T_f \tag{A-1}$$

$$\dot{\overline{\Sigma}} = \overline{S} \times \dot{\overline{S}} = \frac{\overline{S} \times \overline{V}_t - \overline{S} \times \overline{V}_a}{D} \tag{A-2}$$

$$\overline{S} \times \overline{V}_a = (\overline{S} \times \overline{u})V_a - (\overline{u} \times \overline{V}_a) = (\overline{S} \times \overline{u} - \overline{\alpha})V_a \tag{A-3}$$

$$\overline{S} \times \overline{u} = \text{Kinematic Lead} \tag{A-4}$$

Cross multiply $\overline{S}$ with (A-1) to obtain $$D(\overline{S} \times \overline{S}) = 0 = [(\overline{S} \times \overline{u})\, V_m + (\overline{S} \times \overline{V}_a)] \left[\frac{V_a + V_f}{V_a + V_m}\right] - \overline{S} \times \overline{V}_t \tag{A-5}$$

$$\text{From (A-2); } \overline{S} \times \overline{V}_t = D\dot{\overline{\Sigma}} + \overline{S} \times \overline{V}_a \tag{A-6}$$

Substitute (A-3) and (A-6) into (A-5) to obtain $$\dot{\overline{\Sigma}} = \left[\overline{S} \times \overline{u} + \overline{\alpha}\frac{V_a}{V_a + V_m}\left(\frac{V_m - V_f}{V_f}\right)\right]\frac{V_f}{D} \tag{A-7}$$

Equation (A-7) states that the angular velocity, $\dot{\bar{\Sigma}}$, of the reference target RT along the particular line of sight S is directed toward a point slightly above the present gun direction $$\left[\bar{\alpha}\frac{V_a}{V_a+V_m}\left(\frac{V_m-V_f}{V_m}\right)\right].$$

Since this correction term is very small and is the same for all reference targets, it is also conveniently dropped at this point in the analysis and will be added later. With this assumption, $$\dot{\bar{\Sigma}} = (\bar{S}\times\bar{u})\frac{D}{V_f} = \bar{S}\times\dot{\bar{S}} \tag{A-8}$$

The traditional "LCOS" method of mechanizing (A-8) is to measure (or estimate) target range and then solve for the "steady state" solution of the differential equation.

In the present system implementation of (A-8) is achieved as follows:

1. Fix the magnitude of $\bar{S}\times\bar{u}$ (lead angle).
2. Determine range (D) as a function of the magnitude of $\dot{\bar{\Sigma}}$.
3. Solve the differential equation for the direction of $\dot{\bar{\Sigma}}$ and $\bar{S}\times\bar{u}$.

For any particular solution resulting from this procedure, we have a reference target which is always headed so as to be hit by present gun direction but which is at a range dependent upon an aircraft rate of turn ($\dot{\bar{\Sigma}}$) and magnitude of $|\bar{S}\times\bar{u}|$. A multiplicity of such solutions, started at a variety of azimuth angles, provides one or more reference targets (sighting lines) near the actual target so that the possibility of success in the pass may be assessed at the earliest possible time and appropriate control action initiated. The requirement that $\dot{\bar{\Sigma}}$ and $\bar{S}\times\bar{u}$ are in the same direction is imposed by making $$\dot{\bar{\Sigma}}\times(\bar{S}\times\bar{u}) = 0. \tag{A-9}$$

However, since $$\dot{\bar{\Sigma}}\times(\bar{S}\times\bar{u}) = (\bar{S}\times\dot{\bar{S}})\times(\bar{S}\times\bar{u}) = \bar{S}[(\bar{S}\times\dot{\bar{S}})\cdot\bar{u}] - \bar{u}[(\bar{S}\times\dot{\bar{S}})\cdot\bar{S}], \text{ and } (\bar{S}\times\dot{\bar{S}})\cdot\bar{S} = 0, \text{ then } (\bar{S}\times\dot{\bar{S}})\cdot\bar{u} = 0$$

Equation (A-10) states that the line of sight angular velocity is orthogonal to the gun bore axis. This is an entirely equivalent requirement to (A-9) and is a more tractable form.

$\bar{u}\,\bar{v}\,\bar{w}$ is defined to be an orthogonal set of coordinate axes fixed in the aircraft with $\bar{u}$ along the gun bore axis, $\bar{v}$ along the right wing, and $\bar{w}$ normal to the wings (nominally downward). In terms of this coordinate system, whose angular velocity is $\bar{\omega}$, the line of sight derivative, $\dot{\bar{S}}$, is $$\dot{\bar{S}} = \dot{\bar{S}}' + \bar{\omega}\times\bar{S} \tag{A-11}$$

where:

$\dot{\bar{S}}$ = time rate of change of $\bar{S}$ in a non rotating frame of reference.

$\dot{\bar{S}}'$ = time rate of change of $\bar{S}$ with respect to the frame $\bar{u}\,\bar{v}\,\bar{w}$.

$\bar{\omega} = p\bar{u} + q\bar{v} + r\bar{w}$ p = roll rate
q = pitch rate
r = yaw rate $$\bar{\omega}\times\bar{S} = \begin{vmatrix}\bar{u} & \bar{v} & \bar{w}\\ p & q & r\\ S_u & S_v & S_w\end{vmatrix} = \bar{u}(qS_w - rS_v) - \bar{v}(pS_w - rS_u) + \bar{w}(pS_v - qS_u) \tag{A-12}$$

$$\dot{\bar{S}} = \bar{u}(\dot{S}_u + qS_w - rS_v) - \bar{v}(-\dot{S}_v + pS_w - rS_u) + \bar{w}(\dot{S}_w + pS_v - qS_u) \tag{A-13}$$

Since we are seeking $(\bar{S}\times\dot{\bar{S}})\cdot\bar{u}$, only the $\bar{u}$ component of $(\bar{S}\times\dot{\bar{S}})$ need be obtained. Thus, $$(\bar{S}\times\dot{\bar{S}})_u = S_v(\dot{S}_w + pS_v - qS_u) + S_w(-S_v + pS_w - rS_u) \tag{A-14}$$

Imposition of the requirement (A-10) gives $(\bar{S}\times\dot{\bar{S}})\cdot\bar{u} = S_v(\dot{S}_w + pS_v - qS_u) + S_w(-\dot{S}_v + pS_w - rS_u) = O$, (A-15)

From which, $$S_v\dot{S}_w - \dot{S}_v S_w - S_u(qS_v + rS_w) = p(S_v^2 + S_w^2) \tag{A-16}$$

An additional objective is that the lead angle magnitude be constant at a value somewhere near the over-nose vision of the aircraft. This implies that $$|\bar{S}\times\bar{u}| = \text{Sin}\,\lambda_m \tag{A-17}$$

Where: $\lambda_m$ = lead angle magnitude (constant)

But, $$\bar{S}\times\bar{u} = \begin{vmatrix}\bar{u} & \bar{v} & \bar{w}\\ S_u & S_v & S_w\\ 1 & 0 & 0\end{vmatrix} = \bar{v}S_w - \bar{w}S_v \tag{A-18}$$

and $$|\bar{S}\times\bar{u}|^2 = S_w^2 + S_v^2 = \text{Sin}^2\,\lambda_m \tag{A-19}$$

From (A-19)

$$\dot{S}_w S_w + \dot{S}_v S_v = 0 \tag{A-20}$$

Substitute (A-19) and (A-20) into (A-16) to obtain $$-\frac{\dot{S}_v}{S_w}(S_v^2 + S_w^2) = S_u(qS_v + rS_w) - p(S_v^2 + S_w^2) \tag{A-21}$$

or, $$-\frac{\dot{S}_v}{S_w} = \frac{S_u(qS_v + rS_w)}{\text{Sin}^2\,\lambda_m} - p \tag{A-22}$$

Since $S_u^2 + S_v^2 + S_w^2 = 1$, and, $$S_u = \sqrt{1-(S_v^2 + S_w^2)} = \text{Cos}\,\lambda_m \tag{A-23}$$

Therefore $$-\frac{\dot{S}_v}{S_w} = \frac{\text{Cos}\,\lambda_m}{\text{Sin}^2\,\lambda_m}(qS_v + rS_w) - p \tag{A-24}$$

Equation (A-24) is the basic equation for the sighting concept embodied in the present invention. It does not involve approximations of any consequence, and several implementations are possible depending upon the desired level of accuracy and the acceptable level of cost.

Approximations that are useful and quite acceptable for most applications are the following:

$\cos \lambda_m \cong 1$ $\sin \lambda_m \cong \lambda_m$ $\lambda_v$ = elevation sight angle $\cong -S_w$ $\lambda_w$ = traverse sight angle $\cong S_v$ With these approximations, equation (A-24) becomes $$\frac{\lambda_w}{\lambda_v} = \frac{(q\lambda_w - r\lambda_v)}{\lambda_m^2} - p \quad \text{(A-25)}$$

It is convenient to introduce the variables, $$x = \frac{\lambda_w}{\lambda_m} \quad \text{(A-26)}$$

$$y = -\frac{\lambda_v}{\lambda_m} \quad \text{(A-27)}$$

Thus $$\frac{\dot{x}}{y} = p - \frac{(qx + ry)}{\lambda_m} \quad \text{(A-28)}$$

Equation (A-28) is the basic relationship which has been mechanized in the line generating circuit 200 employed in line generator 103 (FIG. 5) and in the other line generators of computer 30 (FIG. 4).

LINE LENGTH GENERATOR 119

As may be seen from equation A-7 above, the magnitude of lead angle ($\bar{S} \times \bar{u}$) required for a hit on a constant velocity target, or one which has its acceleration vector approximately along the line of sight of the attacker, is of the form:

$$\lambda_m = |\dot{\Sigma}| \frac{D}{V_f} - \frac{\alpha_g V_a}{V_a + V_m}\left(\frac{V_m - V_f}{V_f}\right) \quad \text{(B-1)}$$

where:

$\alpha_g = \bar{\alpha}$ = gun angle of attack $V_a$ = true air speed $V_m$ = muzzle velocity Gun angle of attack for typical fighter aircraft is of the form $$\alpha_g = \alpha_a + E \cong \frac{|\dot{\Sigma}| T_o V_o}{\rho V_a} + E \quad \text{(B-2)}$$

where:

$\alpha_a$ = wing angle of attack $V_o$ = reference air speed $T_o$ = path time constant at the reference airspeed $\rho$ = relative air density E = gun elevation angle relative to the zero lift axis of the aircraft Data for a typical fighter aircraft are $V_o$ = 785 fps $T_o$ = 1.12 sec.

Altitude = 20,000 ft.

E = −0.035 rad.

Thus $V_o T_o$ = 877 ft. (B-3)

The 3/2 power drag low is an emperically derived, but widely accepted ballistic model for air to air gunnery. This model assumes bullet aerodynamic drag to be of the form $$A_d = -2k_o \rho V_b^{\frac{3}{2}} = \frac{d V_b}{dt} \quad \text{(B-4)}$$

where:

$k_o$ = ballistic constant $\cong$ 0.00625 (ft-sec.)$^{-1/2}$ $V_b$ = bullet velocity relative to the air mass It is possible to show, by straightforward integration of (B-4), that $$V_f = V_m - k_o \rho D \sqrt{V_a + V_m} \quad \text{(B-5)}$$

Substitution of (B-2) and (B-5) into (B-1) gives $$\lambda_m = \frac{D}{V_f}\left[|\dot{\Sigma}|\left(1 - \frac{k_o V_o T_o}{\sqrt{V_a + V_m}}\right) - \frac{E V_a k_o \rho}{\sqrt{V_a + V_m}}\right] \quad \text{(B-6)}$$

Line length, in radians, to be displayed is $$\Delta_l = \frac{L}{D} \quad \text{(B-7)}$$

Where L = fuselage length.

Solve for D (B-6) and substitute into (B-7) to obtain $$\Delta_l = \frac{L}{\lambda_m \lambda_m}\left[\left(1 - \frac{k_o V_o T_o}{\sqrt{V_a + V_m}}\right)|\dot{\Sigma}| - \frac{E V_a k_o \rho}{\sqrt{V_a + V_m}} + k_o \rho \lambda_m \sqrt{V_a + V_m}\right] \quad \text{(B-8)}$$

Typical parameters are:

$V_a$ = 700 fps $V_m$ = 3300 fps $\rho$ = 0.7

Substitution of these values into (B-8) gives $$\Delta_l = \frac{0.91L}{\lambda_m V_m}\left[|\dot{\Sigma}| - (.0027 - 0.44\lambda_m)\rho\right] \quad \text{(B-9)}$$

or $$\Delta_l = \frac{L}{\lambda_m V_m'}\left[|\dot{\Sigma}| - (.0027 - .44\lambda_m)\rho\right] \quad \text{(B-10)}$$

Where:

$V_m' = V_m/0.91$ $|\dot{\Sigma}| = \sqrt{r^2 + q^2}$

Hence equation (B-10) is the mathematical formula for line length $\Delta_l$ which is implemented by the line length generator 119 circuit shown in FIG. 6.

It will be apparent to those skilled in the art that various modifications and variations could be made in the system of the invention without departing from the scope or spirit of the invention.

What is claimed is:

1. An optical gun sighting system for an aircraft comprising, in combination:

a sighting panel presenting a field of view, including a target image, to a gun operator;

means for generating data signals representing aircraft roll rate, pitch rate and yaw rate;

display means for presenting sighting indicia on said sighting panel superimposed on said field of view; and control means responsive to said data signals for controlling the operation of said display means such that said indicia are presented in fixed lead angle positions on said panel equidistant from a point thereon defining the aiming point of the aircraft gun, said control means being further operable to cause said indicia to move across the sighting panel along a circular path toward a point of convergence defined by the turning plane of said aircraft.

2. The system set forth in claim 1 wherein said display means comprises a cathode ray tube and lens means for directing images of said sighting indicia generated on the face of said tube onto said sighting panel.

3. The system set forth in claim 2 wherein said lens means includes means for collimating said images whereby said sighting indicia appear at infinity in said field of view.

4. The system set forth in claim 2 wherein said control means includes:

symbol generator means adapted to manipulate the beam of said cathode ray tube to trace selected symbols on the face of said tube; and calculating means for generating control signals $\lambda_w$, $\lambda_v$ and x/y and for applying said signals to said symbol generator means to control the latter to manipulate said CRT beam to trace symbols in the form of straight lines representing said sighting indicia, said control signals controlling the positions of said symbols on said CRT in accordance with the equation $$\frac{\dot{x}}{y} = p - \frac{(qx + ry)}{\lambda_m}$$

such that $\lambda_m$ = the fixed lead angle applicable to all symbols $\lambda_w = x\lambda_m$ = the traverse component of the angle $\lambda_m$ defining a particular sighting symbol $\lambda_v = -y\lambda_m$ = the elevation component of the angle $\lambda_m$ defining said particular sighting symbol p = aircraft roll rate q = aircraft pitch rate r = aircraft yaw rate.

5. The system set forth in claim 4 wherein:

said means for generating said roll rate, pitch rate and yaw rate data signals includes analog-to-digital conversion means for producing digital representations of said signals and presenting said representations to said calculating means; and said calculating means includes digital data processing circuits for generating said control signals $\lambda_w$, $\lambda_v$ and x/y in digital form.

6. The system set forth in claim 4 wherein said calculating means comprises:

first circuit means for generating an $\dot{x}$ signal representing the quantity $\dot{x}$ for a particular sighting symbol in accordance with said equation;

second circuit means for integrating said $\dot{x}$ signal to produce an x signal; and third circuit means for periodically resetting said second circuit means to a predetermined constant value whereby the position of said sighting symbol is offset along said circular path in a direction away from said point of convergence.

7. The system set forth in claim 6 wherein said third circuit means is constructed and arranged to reset said second circuit means at regularly timed intervals.

8. The system set forth in claim 4 wherein said calculating means comprises:

a plurality of first circuit means for generating a plurality of $\dot{x}$ signals representing the quantity $\dot{x}$ in accordance with said equation for a plurality of said sighting symbols;

a plurality of second circuit means for integrating said respective $\dot{x}$ signals to produce x signals for said plural sighting symbols; and third circuit means for periodically resetting said second circuit means to a predetermined constant value whereby the positions of said sighting indicia symbols are offset along said circular path in a direction away from said point of convergence, said third circuit means being constructed and arranged to reset individual ones of said second circuit means at different times so that the offsetting of said symbols is staggered in time, producing a continuous train of said symbols moving along said circular path toward said point of convergence.

9. The system set forth in claim 4 wherein said means for generating data signals further includes means for generating a $\rho$ signal representing the relative density of the atmosphere at the altitude of said aircraft and an L signal representing the length of the target and wherein said calculating means further comprises:

means for generating a control signal $\Delta_l$ and applying said signal to said signal generator means to control the length of said straight lines traced by said CRT beam in accordance with the equation $$\Delta_l = \frac{L}{\lambda_m V_m'} [\, |\dot{\Sigma}| - (0.0027 - 0.44\,\lambda_m)\rho]$$

wherein $\dot{\Sigma} = \sqrt{r^2 + q^2}$ $V_m'$ = muzzle velocity of the gun divided by 0.91.

10. The system set forth in claim 9 wherein:

said means for generating said air density signal includes analog-to-digital conversion means for generating a digital representation of said signal and presenting said digital representation to said calculating means; and said calculating means includes digital data processing circuits for generating said $\Delta_l$ control signal in digital form.

11. An optical gun sighting system for an aircraft comprising, in combination:

a sighting panel presenting a field of view, including a target image, to a gun operator;

means for generating data signals representing aircraft performance data;

display means for presenting sighting indicia on said signting panel superimposed on said field of view; and control means responsive to said data signals for controlling the operation of said display means such that said indicia are presented in positions on said panel representing a plurality of hypothetical target positions displaced from the aiming point of said gun by an angular amount defining the fixed lead angle for a predetermined range, said control means being further operable to cause said indicia to move through a circular arc on said panel and to converge on a line describing the turning plane of said aircraft.

12. An optical gun sighting system for an aircraft comprising, in combination:

a sighting panel presenting a field of view, including a target image, to a gun operator;

means for generating data signals representing aircraft pitch rate q, yaw rate r, relative air density $\rho$ and target length L;

display means for presenting sighting indicia on said sighting panel superimposed on said field of view; and control means responsive to said data signals for controlling the operation of said display means such that said indicia are presented as a plurality of straight lines having a length determined as a function of said data signals.

13. A method for providing sighting indicia on a head-up display panel to enable a pilot to execute a high angle-off gun attack on an airborne target comprising the steps of:

generating data signals representing the roll rate p, pitch rate q and yaw rate r of said aircraft;

displaying sighting indicia on said panel at locations displaced from the point on said panel representing the aiming point of said gun by the fixed angle $\lambda_m$, each of said indicia being positioned on said panel in accordance with selected initial coordinate values $x_o$ and $y_o$ defining $\lambda_m$ in terms of traverse and elevation angular components $\lambda = x_o \lambda_m$ and $\lambda_v = -y_o \lambda_m$, respectively; and controlling the positions of said indicia on said panel by varying said $x_o$ and $y_o$ initial coordinate values in accordance with the equation $$\frac{\dot{x}}{y} = p - \frac{(qx + ry)}{\lambda_m}.$$

14. The method set forth in claim 13 wherein:

said step of displaying further includes displaying said sighting indicia in the form of straight lines, one end of each of said lines being located on said panel in accordance with said $x_o$ and $y_o$ initial coordinate values and the slope of said lines being determined by the ratio $x_o/y_o$; and said step of controlling further includes controlling the slopes of said lines on said panel by varying by initial values of $x_o/y_o$ in accordance with said equation.

15. The method set forth in claim 14 wherein:

said step of generating further includes generating data signals representing target fuselage length L and relative air density $\rho$; and said step of controlling further includes controlling the length of said lines in accordance with the equation $$\frac{L}{\lambda_m V_m'} [\, |\dot{\Sigma}| - (0.0027 - 0.44\, \lambda_m)\rho]$$

where $V_m'$ = gun muzzle velocity divided by approximately 0.9

$\dot{\Sigma}$ = aircraft rate of turn.

16. An optical gun sighting system for an aircraft comprising, in combination:

a combining glass arranged to form a sighting panel presenting a field of view, including a target image, to a gun operator;

inertial sensing means constructed and arranged to sense aircraft motion and to generate data signals p, q and r representing aircraft roll rate, pitch rate and yaw rate, respectively;

display means including a cathode ray tube for generating sighting reference lines representing images of hypothetical targets;

lens means for directing an image of said reference lines onto said combining glass superimposed on the field of view of said operator; and control means responsive to said data signals for controlling the operation of said cathode ray tube such that said reference lines are presented on said combining glass displaced at a predetermined angle $\lambda_m$ from a point on said glass defining the aiming point of the aircraft gun, said control means including calculating means for generating control signals $\lambda_w$, $\lambda_v$ and x/y for controlling said cathode ray tube to determine the positions of said lines on said glass, said calculating means operating to produce said control signals in accordance with the equation $$\frac{\dot{x}}{y} = p - \frac{(qx + ry)}{\lambda_m}$$

such that $\lambda_w = x\, \lambda_m$ and $\lambda_v = -y\, \lambda_m$.

17. The system set forth in claim 16 wherein said calculating means is further constructed and arranged to initiate said sighting lines at predetermined starting positions on said glass defined by the initial coordinates $\pm x_o$ and $-y_o$ where $y_o = \sqrt{1 - x_o^2}$ and to thereafter control the positions of said lines by varying said initial coordinates in accordance with said equation.

18. The system set forth in claim 17 wherein said calculating means is further constructed and arranged to initiate said sighting lines at said starting positions in a predetermined time sequence such that plural sighting lines are always visible on said glass.

* * * * *